United States Patent [19]

Kuijt

[11] 4,213,602

[45] Jul. 22, 1980

[54] SWITCHING DEVICE FOR LETTERS AND THE LIKE

[75] Inventor: Cornelis Kuijt, Katwijkaan Zee, Netherlands

[73] Assignee: De Staat der Nederlanden, te Dezen Vertegenwoordigd Door de Directeur-Generaal der Posterijen, Telegrafie en Telefonie, The Hague, Netherlands

[21] Appl. No.: 914,068

[22] Filed: Jun. 9, 1978

Related U.S. Application Data

[63] Continuation of Ser. No. 748,477, Dec. 6, 1976, abandoned, which is a continuation-in-part of Ser. No. 590,625, Jun. 26, 1975, abandoned.

[30] Foreign Application Priority Data

Jul. 16, 1974 [NL] Netherlands ..... 09617

[51] Int. Cl.[2] ..... B65H 29/60

[52] U.S. Cl. ..... 271/279; 198/367; 198/442; 271/184; 271/DIG. 9

[58] Field of Search ..... 271/64, 65, DIG. 9, 271/184, 185, 186, 172, 173, 272, 273, 258, 265, DIG. 2; 214/1 M; 198/437, 367, 442, 633; 209/900

[56] References Cited

U.S. PATENT DOCUMENTS

| | | | |
|---|---|---|---|
| 3,153,483 | 10/1964 | Simjian | 271/258 X |
| 3,352,554 | 11/1967 | Menzi et al. | 271/172 |
| 3,378,251 | 4/1968 | Donabin | 271/186 X |
| 3,391,777 | 7/1968 | Joa | 198/437 X |
| 3,716,178 | 2/1973 | Shimmin | 271/DIG. 9 |
| 3,724,657 | 4/1973 | Katagiri et al. | 271/64 X |
| 3,729,188 | 4/1973 | Stephenson | 271/64 |

*Primary Examiner*—Bruce H. Stoner, Jr.
*Attorney, Agent, or Firm*—Hugh Adam Kirk

[57] ABSTRACT

Belt type conveyors for letters and the like, having a switching device between them, which device comprises a roller having a flattening on its circumference i.e. a segmented roller, driven by means of a one-rotation coupling when a letter is sensed on the conveyor approaching the switching device.

2 Claims, 3 Drawing Figures

SWITCHING DEVICE FOR LETTERS AND THE LIKE

RELATED APPLICATIONS

This is a continuation of application Ser. No. 748,477 filed Dec. 6, 1976, now abandoned, which is a continuation-in-part of application Ser. No. 590,625 filed June 26, 1975, now abandoned.

BACKGROUND OF THE INVENTION

Previously, transport devices for letters and the like, comprising a switching device generally comprised a resilient or pivoting tongue, which was directed against or away from the stream of letters. These types of switching tongues were held in a normal position such as by a spring and were driven into their switching or operating positions by various known electric or pneumatic means. The drawbacks of these switching tongues are slowness, vulnerability and the possibility of blocking. Another type of switching device comprised a conveyor-belt part which is projected into a path by means of a movable roller. The working of this type too is slow, and the conveyor-belt must be of an elastic kind which is always subject to an excessive wear.

SUMMARY OF THE INVENTION

The present invention provides a new type of switching device with many advantages. This switching device consists of a means such as segmented roller, i.e. a roller having a flattening on its circumference, which roller is coupled to a driving device by means of a one-rotation coupling. The flattened portion of the roller ensures a free passage of the latters along a conveyor when the roller is in its normal position, and the rotation of the segmented roller means urges the letter into contact with and in the same direction as a moving conveyor belt to change the path of said letter into the branching path system of the moving conveyor belt.

Thus, the switching device according to this invention is an active element in contradistinction to the switching devices having the shape of tongues, which are passive elements. The segmented roller means or element can co-operate in its working position with a movable conveying element that is provided with driving means in such a way that the letter being pinched between the two elements can even be given an opposite direction of movement. This system also may be provided with a detector for controlling the one-rotation coupling for the segmented roller means, which detector can be arranged to react to the trailing edge of the letters supplied.

Objects and Advantages

Accordingly, it is an object of this invention to produce a simple, efficient, effective, economical, active, robust, and fast conveyor switching device which reduces blocking and wear to their minimums.

BRIEF DESCRIPTION OF THE VIEWS

The above mentioned and other features, objects and advantages, and a manner of obtaining them are described more specifically below by reference to embodiments of this invention shown on the accompanying drawings, wherein.

DETAILED DESCRIPTION OF PREFERRED EMBODIMENTS

Figure 1:
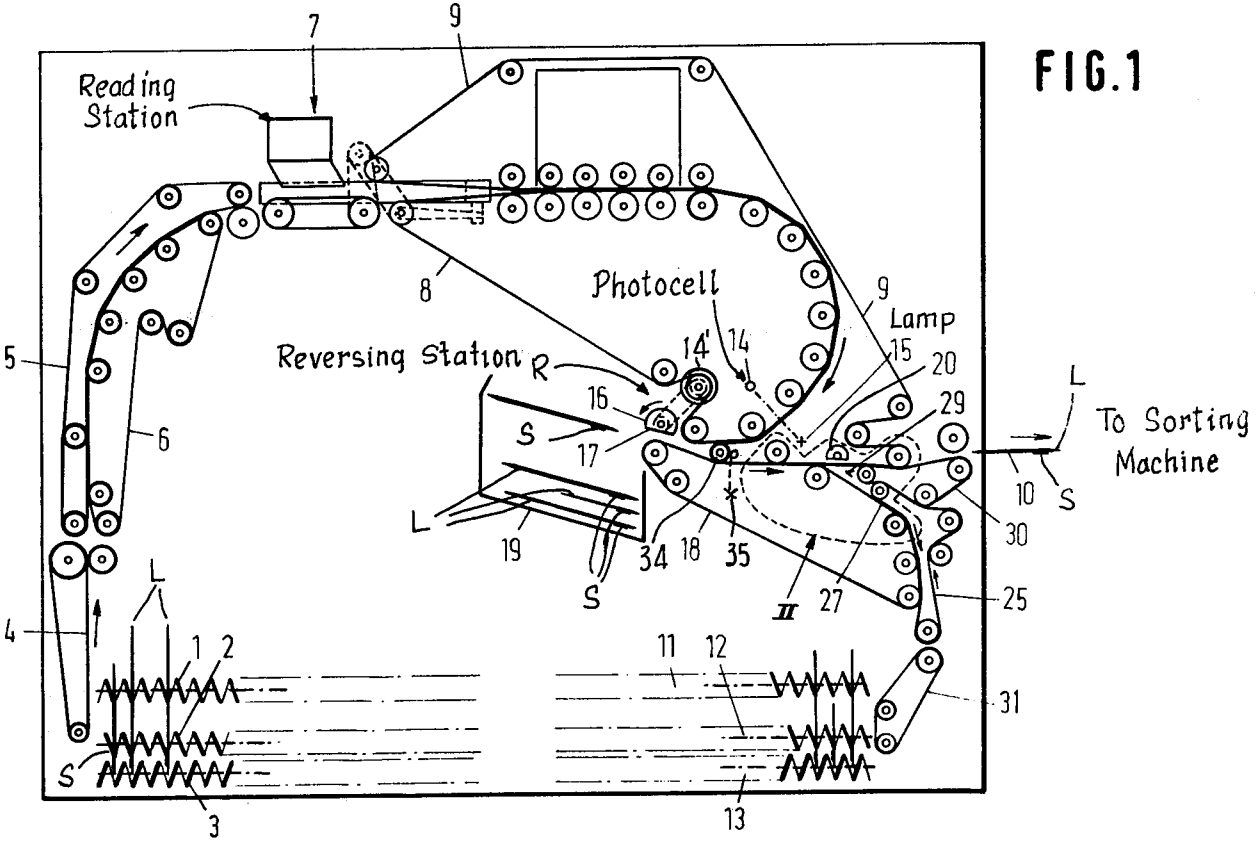
FIG. 1 is a schematic side view of a conveyor system in a letter sorter hopper employing two embodiments of this invention.

FIG. 1 relates to a hopper in which the switching device of this invention is employed in two different ways. The hopper is utilized in a sorting machine. In the hopper the mail or letters L to be sorted are placed on the conveyor worms 1, 2, and 3, which lead the letters L to a sucking or lifting conveyor-belt 4. The letters L then are led between two conveyor-belts 5 and 6 to a reading station 7, at which the postal code on the letters L is read automatically. Then the letters L are led between two conveyor-belts 8 and 9 to a reversing station R employing the first use of the switching device of this invention, where they are to be reversed and then either led to the sorting machine, like the letter 10, or placed on the conveyor worms 11, 12 and 13. The thickness of the letters shown in FIG. 1 indicates the location of the stamps. The letters can be transferred by hand from the worms 11, 12 and 13 to the worms 1, 2 and 3. In this case they need not be reversed and shuffled, due to the reversing device R performing the automatic reversal of their direction, since they must always be in the same position when handled by the reading station 7.

The reversal of the direction of the letters takes place as follows. Beyond the reading station 7, the letters pass by a detector consisting of a photo-electric cell 14, which is irradiated by a source of light 15. The photo-electric cell 14 is so arranged that the trailing edges of the letters L are detected. As a result of the detection, a switching or reversing device R comprising a roller 16 having a flat side or segment 17 is driven by the conveyor-belt 8 by a means of a one-rotation coupling 14', similar to the coupling 24 shown in FIG. 3. As controlled by the photo-electric cell 14, the roller 16 makes one rotation and then stops in the position shown. When the roller 16 rotates, a detected letter L is pinched between the circumference of the roller 16 and a conveyor-belt 18, whereby its direction is reversed.

Irregularities may occur with the lifting or sucking conveyor-belt 4. The letters L may not only differ in length, but they may also slip when they are lifted. Consequently, the space between two successive letters may be small or the letters may overlap each other in such a way that difficulties will arise in the sorting machine. Whenever the letters overlap each other, the roller 16 is not driven, so that the flattening 17 allows a free passage of at least the first letter, which then drops into a receptacle 19. The detector 14 is so arranged that even in the case of too small a space between the letters, the roller 16 is not driven. These letters which overlapped each other, are collected in the receptacle 19 and can be placed on the worms 1, 2 and 3 again.

Figure 2:
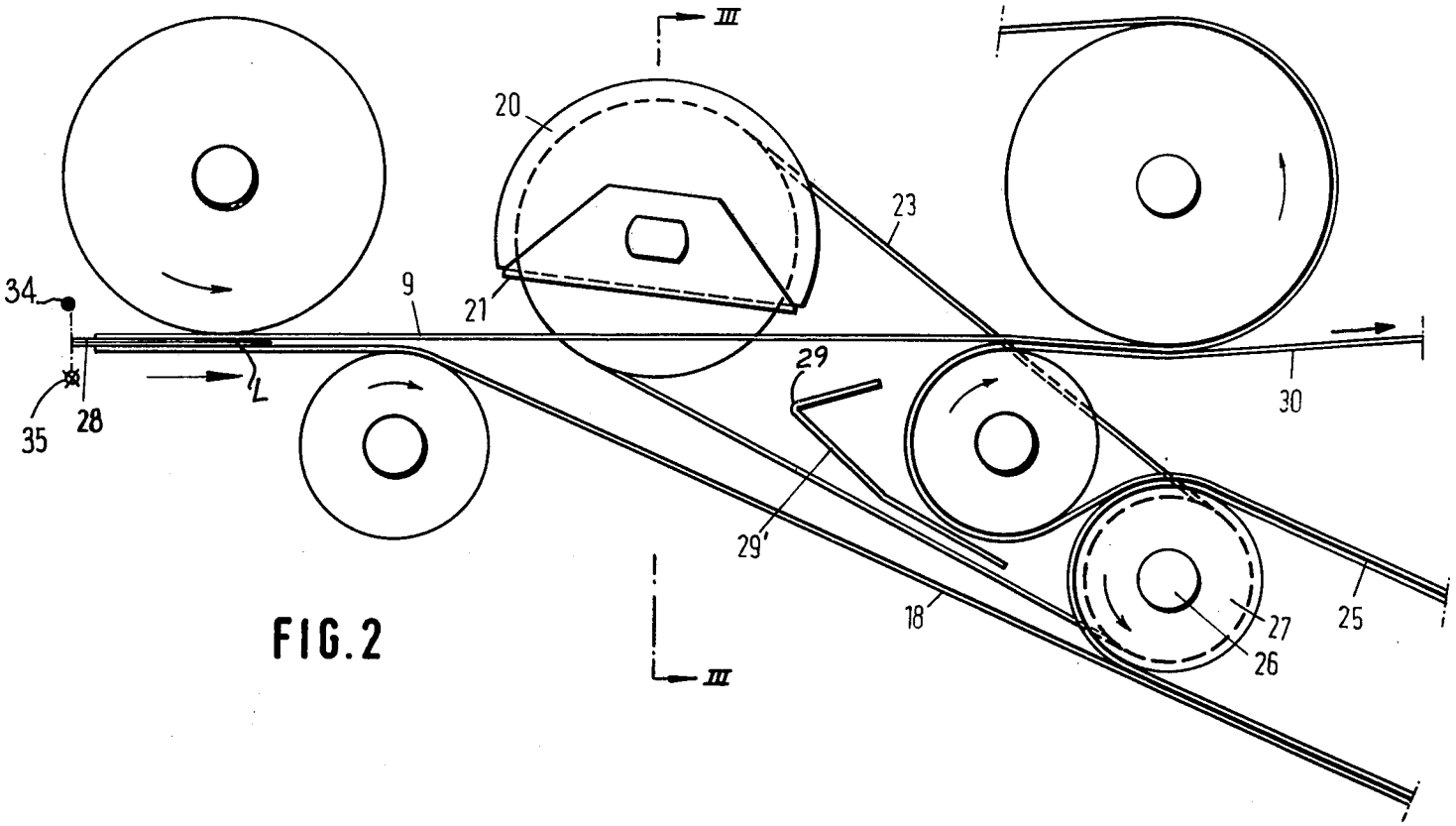
FIG. 2 is a schematic enlargement of the portion II shown in dotted lines in FIG. 1 of one of the embodiments of this invention.
Figure 3:
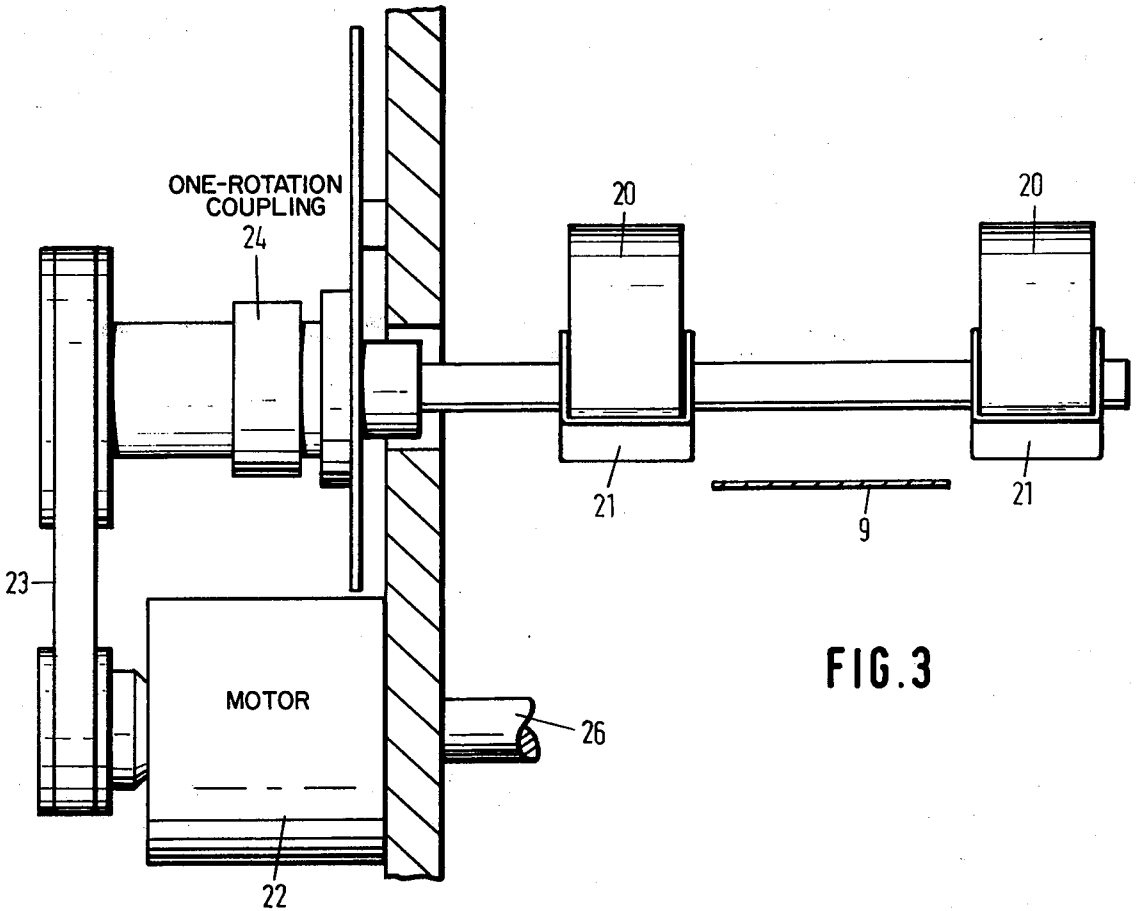
FIG. 3 is a section taken along line III—III of FIG. 2.

The letters L which are reversed are pinched between the conveyor-belts 9 and 18 and taken to the next switching arrangement II which is also represented on a larger scale in FIGS. 2 and 3. This switching device II comprises a double roller 20 provided with a flattened segment 21 (FIG. 3). The roller 20 is driven by a motor 22 by means of a transmission-belt 23 and a one-rotation coupling 24. By means of a shaft 26 and a driving roller 27, the motor 22 also drives a conveyor-belt 25. With the roller 20 in the position shown, the letter 28 goes straight onto a belt 30 as shown in FIG. 2 and may be, if necessary, helped by a guide portion 29, until it is pinched between the conveyor-belt 9 and the conveyor-belt 30 and led to the sorting machine.

However, under the control of a photo-electric cell 34 and light source 35, similar to photocell 14 and light source 15 shown in FIG. 1 between conveyor belts 8 and 9, detecting the leading edge of the letters L, and a processor (not shown), the one-rotation coupling 24 can be operated to rotate the roller 20 one revolution to change the direction of the letter 28. This letter L, 28, which may be aided by the guide portion 29', if necessary, is now pinched between the conveyor-belts 18 and 25, which belts guide the letter L, 28 to a conveyor-belt 31 and the worms 11, 12 and 13 (see FIG. 1).

While there is described above the principles of this invention in connection with specific apparatus, it is to be clearly understood that this description is made only by way of example and not as a limitation to the scope of this invention.

I claim:

1. A system for conveying and selectively delivering letter-type objects to at least two separate locations, comprising:

(A) a driven stem belt conveyor for conveying said letter-type objects along a first path to a location having a receptacle for accumulating said letter-type objects, (B) a driven branch belt conveyor below said driven stem belt conveyor for conveying said letter-type objects along a second path to another location, which second path extends in an opposite direction to said first path, (C) a switching device located along said first path to said receptacle and immediately adjacent thereto and operable to switch selectively said letter-type objects from said first path to said second path, said switching device comprising a one-rotation means adjacent said branch belt conveyor, said one rotation means having an incomplete cylindrical surface of which the non-cylindrical part is normally out of said first path of said letter-type objects moved by said stem belt conveyor, and of which the cylindrical surface part serves for engaging said letter-type objects to pinch them downward into contact with said opposite moving branch belt conveyor for conveying said objects to said other location, (D) photoelectric means for sensing the trailing edges of said letter-type objects as they move along said stem belt conveyor toward said switching device, and (E) a one-rotation coupling means driving said one-rotation means under control of said sensing means for rotation of said one-rotation means in said opposite direction to move said letter-type objects in the same direction as said branch belt conveyor, whereby whenever the space between two successive letter-type objects is small or the letter-type objects overlap one another said switching device is not rotated so that the non-cylindrical part allows free passage of said letter-type objects to said receptacle.

2. A system according to claim 1 wherein said one-rotation device comprises a segmented roller.

* * * * *